United States Patent [19]

Price et al.

[11] 3,941,862

[45] Mar. 2, 1976

[54] GAS DIFFUSING ASSEMBLY

[75] Inventors: John H. Price, LaJolla; Miguel A. Ruksenas, Fallbrook, both of Calif.

[73] Assignee: Hudson Oxygen Therapy Sales Company, Temecula, Calif.

[22] Filed: Dec. 11, 1973

[21] Appl. No.: 423,672

[52] U.S. Cl. ..... 261/122; 128/194; 261/DIG. 65

[51] Int. Cl.[2] ..... B01F 3/04

[58] Field of Search..... 261/122, DIG. 65, 123, 261/124; 128/194, 185, 187, 186, 192, 188

[56] References Cited

UNITED STATES PATENTS

| | | | |
|---|---|---|---|
| 1,326,174 | 12/1919 | Borcherdt | 261/122 X |
| 1,343,123 | 6/1920 | Gahl et al. | 261/122 |
| 1,537,265 | 5/1925 | Ruth, Jr. | 261/122 X |
| 2,584,450 | 2/1952 | Holt et al. | 261/122 X |
| 3,215,140 | 11/1965 | Caparrelli | 261/122 X |
| 3,365,860 | 1/1968 | Boris | 261/122 X |
| 3,378,238 | 4/1968 | Babington et al. | 261/122 X |
| 3,432,154 | 3/1969 | Danjes | 261/122 |
| 3,440,307 | 4/1969 | Printz | 261/122 X |
| 3,472,425 | 10/1969 | Booth et al. | 261/122 X |
| 3,490,752 | 1/1970 | Danjes et al. | 261/122 |
| 3,757,082 | 9/1973 | Goicoechea | 261/DIG. 65 |
| 3,769,163 | 10/1973 | Brumfield | 261/122 X |

*Primary Examiner*—Tim R. Miles
*Assistant Examiner*—Richard L. Chiesa
*Attorney, Agent, or Firm*—Jerry R. Seiler

[57] ABSTRACT

An assembly for diffusing gas in a humidifier comprises a base plate having a wall extending around its periphery, a diffuser sheet comprising a substantially gas impermeable membrane having a plurality of perforations and a member for directing gas to be humidified into a gas receiving chamber defined between the diffuser sheet and base plate. In a humidifier, the assembly is submerged in water and gas travels through the gas directing member, into the gas receiving chamber and outwardly through the perforations in the diffuser sheet into the water where it is humidified and exits from the humidifier.

11 Claims, 9 Drawing Figures

GAS DIFFUSING ASSEMBLY

BACKGROUND OF THE INVENTION

Humidifiers are devices used in inhalation therapy for achieving a gaseous mixture having a desirable relative humidity. In the administration of oxygen containing gaseous mixtures to patients, it is highly desirable to humidify the gas to a relative humidity of about 60% at 70°F. Breathable oxygen containing gases should have a relative humidity of at least about 30% and sometimes, for therapeutic reasons, relative humidity as high as about 90% is desired. Low humidity is undesirable since it causes serious drying of the moist membranes within the nose, sinuses, mouth, throat and respiratory tracts which may compound certain respiratory ailments. At a relative humidity of about 60%, not only is such drying avoided but bacteria and dust generally precipitate from the air, thereby keeping airborn pathogens to a minimum. A simple humidification apparatus is a humidifier which utilizes water in a receptacle or container portion through which the gas is bubbled thereby picking up moisture and achieving about 50% relative humidity. When the humidifier is used in mask therapy, the patient's natural humidifying mechanisms will usually provide the required additional amount of moisture for achieving the desired humidity during therapy.

In achieving gas humidification by this method, the dry gas is often directed through a diffuser comprising an element having a plurality of openings through which the gas is forced. However, in state of the art devices, the units are somewhat noisy, and often do not achieve the desired amount of gaseous diffusion or distribution within the water. It is to the elimination of problems with prior art humidification diffusers that the present invention is directed.

SUMMARY OF THE INVENTION

It is an object of the present invention to provide a gas diffusing assembly which optimizes gas distribution. It is another object to provide a diffuser which is relatively quiet and at the same time distributes gas over a large distribution area so as to increase the degree of humidification. These objects are achieved by the device of the invention which utilizes a base plate around which a peripheral wall extends and a diffuser sheet which comprises a gas impermeable membrane incorporating a large number of perforations. The diffuser sheet is secured to the base plate wall and includes an orifice for a gas directing member, around which member the sheet is also secured. A gas receiving chamber is defined between the plate and membrane. The improved device is constructed of a relatively few number of parts and is inexpensive to produce and easy to assemble. These as well as other advantages and objects of the invention will be evident from the following detailed description.

DETAILED DESCRIPTION OF THE INVENTION

Figure 1:
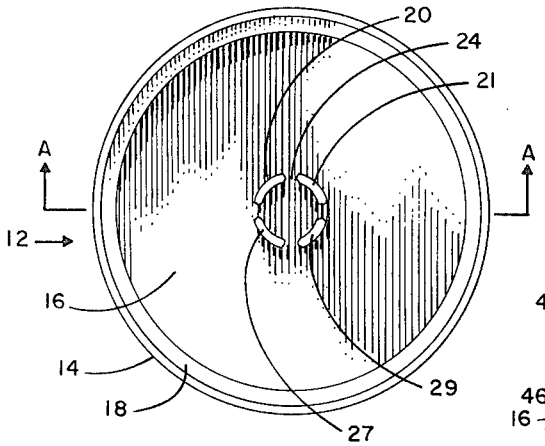
FIG. 1 is a top plan view of the base plate member of the diffuser assembly.
Figure 3:
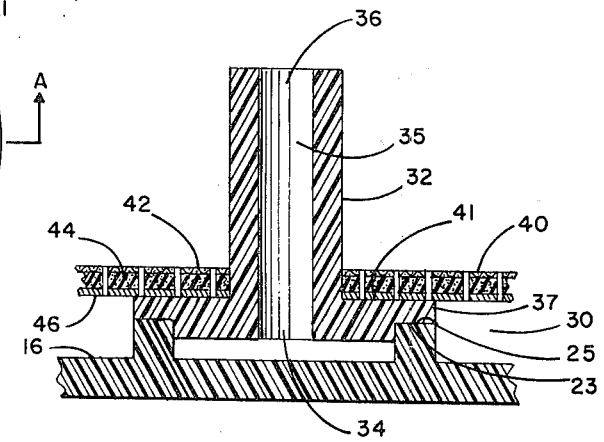
FIG. 3 is an enlarged side sectional elevation at the center of the assembly illustrating the cooperation of the components.
Figure 5:
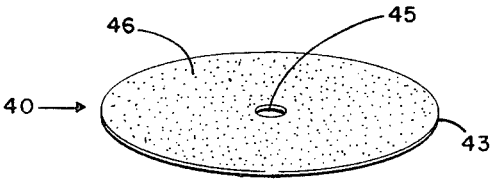
FIG. 5 is a perspective view of the under side of the diffuser sheet.
Figure 6:
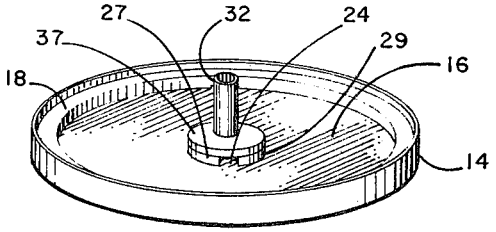
FIG. 6 is a perspective view of the base plate and secured gas directing member.
Figure 8:
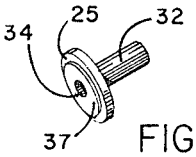
FIG. 8 is a perspective view of the gas directing member.

Specifically, the diffuser apparatus of the invention comprises a base plate 12 as illustrated in FIG. 1, a gas directing member 32 as shown in FIGS. 3, 6 and 8 and a diffuser sheet 40 shown in FIGS. 3 and 5. The gas directing member is attached or extends upwardly from the base plate as illustrated in FIGS. 3 and 6 and the diffuser sheet overlies the base plate and a portion of the gas directing member whereby a gas receiving chamber is created and defined between the base plate and diffuser sheet. Gas is directed into this chamber and outwardly through a plurality of orifices in the diffuser sheet beneath the surface of the water in a humidifier.

Figure 2:
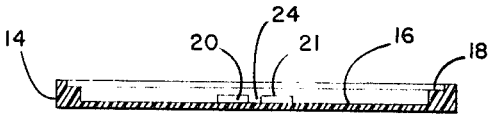
FIG. 2 is a side sectional elevation taken along line A—A of FIG. 1.

Referring specifically to FIGS. 1 and 2, there is shown the base plate 12. In the embodiment shown, the base plate has a generally flat upper surface 16 and a wall 14 extending around its outer periphery. However, the base plate may be somewhat concave in shape so that the outer edge acts as a wall for securing the diffuser sheet therearound. The height of wall 14 is not particularly critical and will depend on the depth of the gas receiving chamber desired. Preferably interiorly of the wall there is a platform 18 to which the outer edge of the diffuser sheet may be attached. Platform 18 extends substantially around the entire base plate as shown. There is also preferably exposed on the upper base plate surface 16, one or more boss members or similar protubrances or projections for supporting the gas directing member. The boss or bosses must be provided with an opening or means for communicating the end of the gas directing member with the gas receiving chamber. Acccordingly, four bosses 20, 21, 27 and 29 are shown in FIG. 1 between adjacent ones of which is an opening or port 24. Thus, the bosses act as a stand or fixture on which the gas directing member is secured and supported.

Referring also to FIGS. 3, 6 and 8 the gas directing member 32 is shown. it comprises a conduit 35 having upper and lower openings 36 and 34 respectively through which a gas may be directed. Preferably, the gas directing member has a flared base portion 37 (FIGS. 3, 7 and 8) which rests on the bosses in such a manner that lower opening 34 of the member is spaced or displaced from upper surface 16 of base plate 12. With this spacial arrangement, gas directed downwardly through conduit 35 will exit from lower end 34 and pass through ports 24 between the bosses and outwardly into the gas receiving chamber.

Noting also FIG. 8, the lower surface of flared base portion 37 of the gas directing member may be provided with a peripheral recess 25 which fits on the upper surface 23 of the bosses. This feature will allow the gas directing member to be snapped into place on the bosses as shown in FIG. 6 and in cross-section observed in FIG. 3. However, it will be understood that such a feature is not critical and is an illustration showing preferred embodiments of the invention. Other equivalent means of securing the gas directing member in the apparatus such as by adhesive, bonding, etc., and maintaining its separation from the base plate for adequate flow of gas through the conduit and into the gas receiving chamber, will be appreciated by those skilled in the art and are within the purview of the invention.

Figure 4:
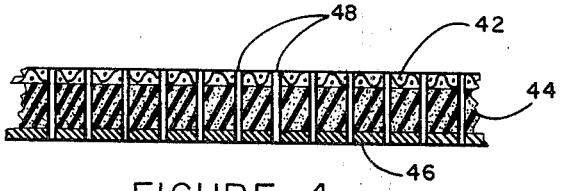
FIG. 4 is an enlarged sectional view of a diffuser sheet.
Figure 7:
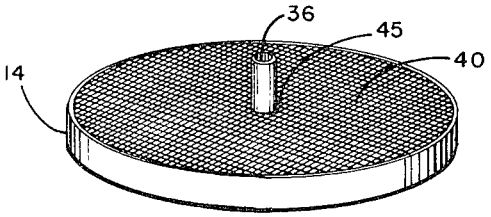
FIG. 7 is a perspective view of the assembled diffusing assembly of the invention.

FIGS. 3–5 illustrate the diffuser sheet through which gas from the gas receiving chamber is forced. The diffuser sheet such as is shown in FIGS. 5 and 7, comprises a substantially gas impermeable membrane 40 having a large number of perforations, preferably uniformly spaced. This membrane may be any thin, soft, pliable sheet or layer having the plurality of perforations and which otherwise is gas impermeable. The membrane will have the same peripheral shape as the peripheral shape of the base plate. In other words, if the base plate is square, so will be the shape of the diffuser sheet or membrane. The membrane shown is circular and although preferable, is only by way of illustration.

Observing also FIG. 5, the diffuser sheet is provided with an opening 45 through which gas directing member 32 will extend when the apparatus is assembled as shown in FIG. 7. Moreover, the membrane is to be secured to the base plate as well as the flared base of gas directing member so that a gas receiving chamber is defined between the membrane and the upper surface of the base plate and which chamber is gas sealed except for the perforations in the membrane and the ports between the bosses. Thus, the outer peripheral edge of the membrane is adhered to shelf 18 or otherwise secured substantially around the interior of wall 14 of base plate 12 whereas a circular area beneath opening 45 is adhesively or otherwise bonded to the upper surface 41 of the flared base portion of the gas directing member as shown in FIG. 3. In this manner, when the diffuser sheet or member is assembled in the area as shown in FIG. 7, the membrane will be spaced or separated from the upper surface 16 of base plate 12 as shown in FIG. 3 which space forms the gas receiving chamber 30.

The diffuser sheet is produced of a material which is not affected by water and is preferably synthetic material such as synthetic leather or a polyvinyl compound, or it may comprise or include other synthetic materials such as elastomers and other soft pliable resinous sheet materials. Again, so long as the membrane is flexible or pliable and water resistent, and is capable of being attached to the base plate wall and gas directing member, the type of material is not so critical. Although other synthetic resinous sheets may be used, the preferred materials are polyvinyl compounds and more preferably polyvinyl chloride which is available in a number of different forms. Although a single layer sheet may be used, that shown in FIGS. 3 and 4 is multi-layered. In the embodiment shown a first layer 46 comprises a film of polyvinyl chloride to which is secured a foamed or expanded polyvinyl chloride layer 44. On top of this is secured fabric layer 42 to form a sheet of flexible, pliable and water resistent material through which a rather large number of perforations 48 are uniformly spaced. The number of perforations which may be used will vary as desired but for maximum dispersion and humidification of gas, the greater number of perforations, the greater the efficiency of the humidifier. Accordingly, the diffuser sheet used is preferably one having a perforation density of between about 100 and about 1000 per square inch and more preferably between about 200 and about 600. These perforations will extend entirely through the sheet, and again are preferably uniformly spaced to achieve uniform distribution of the diffused gas. The diameter of the perforations or small holes may be between about 0.001 and about 0.002 inch and are preferably uniform so that gas will be generally uniformly forced from all perforations. by way of example, a useful material is Naugahydes, available commercially, and having between about 300 and about 400 perforations per square inch. However, it will be appreciated that other similar and equivalent diffuser sheet materials may be used.

In assembling the apparatus, it will be noted that gas directing member 32 will be secured to the upper surface 23 of the bosses as illustrated in FIGS. 3 and 6. Preferably, the base plate 12, bosses and peripheral wall are all molded or otherwise formed out of a single material, preferably plastic, which may be polystyrene, polyethylene, rigid polyvinyl chloride and the like. The gas directing member may be of the same material so that they may be secured by an adhesive if desired although that is not necessary. The important aspect is that there will be at least one port or other means of communication between the lower end of the gas directing member and the gas receiving chamber. When the membrane is to be secured, adhesive or other material is placed adjacent the center opening 45 and around the outer periphery of the membrane and it is then pressed onto the apparatus with the gas directing member extending through the opening 45.

Figure 9:
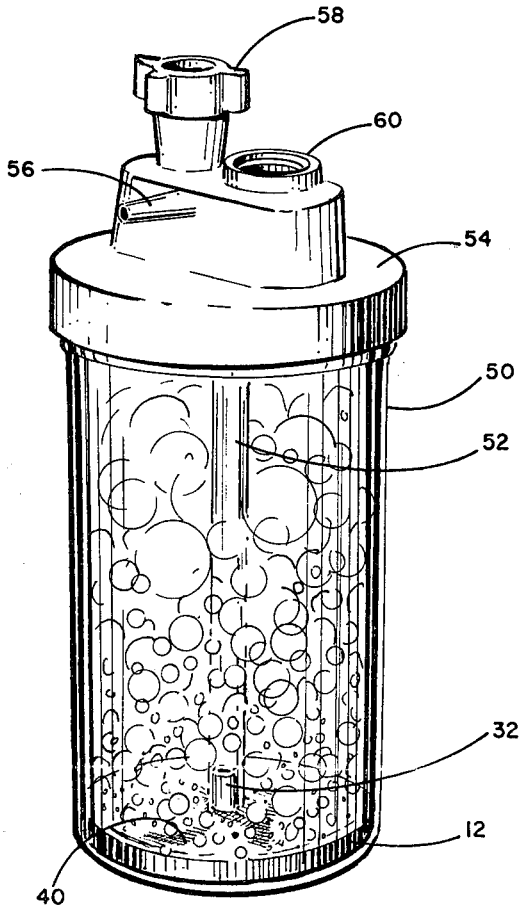
FIG. 9 is a view showing the diffusing assembly of the invention in a humidifier.

Observing FIG. 9, the assembly of the invention is placed below the surface of water in a humidifier jar 50 and a tube 52 is secured to gas directing member 32. The humidifier shown includes a cap 54 having a safety release valve 60, threaded oxygen coupling 58 and an outlet means in the form of a conduit or pipe 56. With water in the jar or receptacle of the humidifier, gas is directed from a source, usually pressurized oxygen or oxygen containing gas, through coupling 58 and the tube 52, into gas directing member 32, outward through ports 24 between the bosses and into gas receiving chamber. The gas will then be forced out through the plurality of orifices of the diffuser sheet membrane where it will be directed upward through the water picking up moisture and is directed from outlet pipe 56 on to the patient for inhalation therapy.

We claim:

1. In a humidifier for increasing humidification of an oxygen containing gas for inhalation therapy having a water holding receptacle and conduit means for directing the gas, a diffuser for said gas comprising:

a. a base plate having an outer peripheral edge;

b. a diffuser sheet comprising a substantially gas impermeable membrane of polyvinyl chloride, a foamed polyvinyl chloride layer secured to one side of said membrane and a fabric backing secured on said foam layer opposite said membrane, and having a plurality of uniformly spaced perforations therethrough the outer periphery of which sheet is secured to said base plate adjacent its peripheral edge, said sheet and said plate cooperating to define a substantially open and undivided gas receiving chamber therebetween; and c. a gas directing member having an upper end extending exteriorly from said gas receiving chamber and a lower end within said chamber and communicating therewith, whereby gas is directed through said gas directing member into said gas receiving chamber and outwardly through said perforations.

2. The assembly of claim 1 wherein said membrane includes an orifice through which said gas directing member extends.

3. The assembly of claim 2 wherein said membrane around said orifice is secured adjacent said member whereby said chamber is substantially air tight except for said perforations.

4. The assembly of claim 3 wherein said base plate has a wall extending around its outer peripheral edge to which wall said diffuser sheet is attached.

5. The assembly of claim 4 wherein said base plate is generally flat and said wall extends normal to the plane of said flat plate.

6. The assembly of claim 3 wherein said perforations are substantially uniformly spaced and number between about 100 and about 1000 per square inch.

7. The assembly of claim 1 wherein said gas directing member is a hollow tube.

8. The assembly of claim 1 wherein said base plate includes a boss for supporting the lower end of said gas directing member and said boss member having means communicating with said lower end and said chamber.

9. The assembly of claim 8 wherein said boss comprises a plurality of boss members extending normal to said base plate and said communication means comprises a port between adjacent boss members.

10. The assembly of claim 9 wherein said gas directing member includes recess means for engaging said boss members.

11. The humidifier of claim 1 wherein said diffuser is disposed adjacent the bottom of said receptacle and wherein said diffuser overlies substantially the entire receptacle bottom.

* * * * *